US011758331B2

(12) United States Patent
Pan

(10) Patent No.: US 11,758,331 B2
(45) Date of Patent: Sep. 12, 2023

(54) BALANCED VIBRATION SYSTEM

(71) Applicant: Guochang Pan, Shouguang (CN)

(72) Inventor: Guochang Pan, Shouguang (CN)

(73) Assignee: Guochang Pan, Shouguang (CN)

( * ) Notice: Subject to any disclaimer, the term of this patent is extended or adjusted under 35 U.S.C. 154(b) by 0 days.

(21) Appl. No.: 17/594,840

(22) PCT Filed: Oct. 11, 2019

(86) PCT No.: PCT/CN2019/110531
§ 371 (c)(1),
(2) Date: Nov. 1, 2021

(87) PCT Pub. No.: WO2020/228229
PCT Pub. Date: Nov. 19, 2020

(65) Prior Publication Data

US 2022/0312121 A1 Sep. 29, 2022

(30) Foreign Application Priority Data

May 14, 2019 (CN) ..... 201910396055.1

(51) Int. Cl.
*H04R 9/02* (2006.01)
*H04R 7/18* (2006.01)

(52) U.S. Cl.
CPC ..... *H04R 9/025* (2013.01); *H04R 7/18* (2013.01)

(58) Field of Classification Search
CPC ..... H04R 9/025; H04R 7/18
See application file for complete search history.

(56) References Cited

U.S. PATENT DOCUMENTS

2015/0207392 A1* 7/2015 Iwakura ..... H02K 33/00 310/25
2017/0244309 A1* 8/2017 Iwakura ..... H04R 11/02

FOREIGN PATENT DOCUMENTS

CN 110012398 A 7/2019

OTHER PUBLICATIONS

International Search Report issued in International Application No. PCT/CN2019/110531; dated Jan. 23, 2020; 7 pgs.
Written Opinion issued in International Application No. PCT/CN2019/110531; dated Jan. 23, 2020; 9 pgs.

* cited by examiner

*Primary Examiner* — Sunita Joshi
(74) *Attorney, Agent, or Firm* — HAUPTMAN HAM, LLP

(57) ABSTRACT

A balanced vibration system including a magnetic circuit unit, a vibration unit and a casing. The magnetic circuit unit and the vibration unit are inside the casing. The vibration unit includes a balanced iron core and a vibrating diaphragm; the balanced iron core is movably connected with the casing, the vibrating diaphragm is fixed on the casing, and the balanced iron core drives the vibrating diaphragm; the magnetic circuit unit includes a magnetic circuit coil and magnet groups, the magnetic circuit coil is sleeved on the balanced iron core, and the two magnet groups are respectively located at ends of the balanced iron core along an axial direction; each magnet group includes magnets which are arranged oppositely at both sides of the balanced iron core; when the magnetic circuit coil is ON, magnetic field forces applied by the two magnet groups to the balanced iron core are same in direction.

15 Claims, 3 Drawing Sheets

BALANCED VIBRATION SYSTEM

RELATED APPLICATIONS

The present application is a U.S. National Phase of International Application Number PCT/CN2019/110531 filed Oct. 11, 2019 and claims priority to Chinese Application Number 2019103960551 filed May 14, 2019.

TECHNICAL FIELD

The present invention relates to the field of balance technologies, and in particular to a balanced vibration system.

BACKGROUND

In the prior art, vibration systems are divided into a moving coil type and a moving iron type on principle. In the moving coil type, a magnetic circuit coil vibrates to drive a vibrating diaphragm to vibrate so as to generate sound. In the moving iron type, a magnetic circuit coil is stationary, and an end of a balanced iron core in the center of the coil vibrates to drive a vibrating diaphragm to vibrate so as to generate sound.

In the moving iron type of the prior art, an end of the balanced iron core in the center of the magnetic circuit coil vibrates in a magnetic field due to magnetic change of the coil resulting from change of a current. In this case, an end of the balanced iron core vibrates and the other end of the balanced iron core is fixed. In this way, an elastic suspension arm with one end fixed and the other end vibrating is formed. Thus, the vibrating end can generate vibration by overcoming an elastic stress of the balanced iron core, leading to loss of energy. Furthermore, the resulting vibration cannot go on fully as per the requirements of the coil current, i.e. electrical signals, producing distortion. This is an unbalanced vibration system.

SUMMARY

In order to overcome the above shortcomings of the prior art, the present invention provides a balanced vibration system aimed to solve the problems of low signal conversion efficiency, large energy loss and single-side vibration-generated distortion.

In order to solve the above technical problems, the present invention employs the following technical solution.

Provided is a balanced vibration system, including a magnetic circuit unit, a vibration unit and a casing, where the magnetic circuit unit and the vibration unit are located inside the casing, the vibration unit includes a balanced iron core and a vibrating diaphragm; the balanced iron core is movably connected with the casing. The vibrating diaphragm is fixed on the casing, and the balanced iron core drives the vibrating diaphragm to move. The magnetic circuit unit includes a magnetic circuit coil and two magnet groups, the magnetic circuit coil is sleeved on the balanced iron core, and the two magnet groups are respectively located at both ends of the balanced iron core along an axial direction. Each magnet group includes two magnets which are arranged oppositely at both sides of the balanced iron core. When the magnetic circuit coil is in a powered-on state, magnetic field forces applied by the two magnet groups to the balanced iron core are same in direction.

Preferably, there is one magnetic circuit coil located between two magnet groups and both ends of the magnetic circuit coil are fixedly connected with the two magnet groups respectively.

Preferably, there are two magnetic circuit coils which are located at the opposed or contrary sides of the two magnet groups respectively, and a corresponding end of each magnetic circuit coil is fixedly connected with the magnet group adjacent to the magnetic circuit coil.

Preferably, the vibration unit further includes a connection piece, one end of which is fixedly connected with the balanced iron core and the other end is fixedly connected with the vibrating diaphragm.

Preferably, the balanced iron core and the vibrating diaphragm are of integral structure, an edge of the vibrating diaphragm is fixedly connected with the casing, and the balanced iron core drives the vibrating diaphragm to vibrate up and down for sound generation.

Preferably, magnetic poles of the opposed ends of the two magnets in a same magnet group are opposite.

Preferably, a magnetic field direction between two magnets in one magnet group is opposite to a magnetic field direction between two magnets in the other magnet group.

Preferably, the balanced iron core is connected with the casing through an elastic component, and the elastic component enables the balanced iron core to stay at a central position of the magnetic circuit unit in a case that the magnetic circuit coil is in a non-powered-on state.

Preferably, the balanced vibration system further includes a support body, where the support body is fixed inside the casing, and all magnets are mounted on the support body.

Preferably, the elastic component is a spring or a spring sheet.

Preferably, the balanced iron core is made of a magnetically-conductive material.

The working principle of the present invention is described below.

The balanced iron core is made of a magnetically-conductive material; after electrical signals pass through the magnetic circuit coil of the magnetic circuit unit, the balanced iron core is magnetized to enable both ends of the balanced iron core to have magnetic poles; both ends of the balanced iron core are located in two magnet groups respectively, and the two magnet groups apply magnetic forces which are equal in size and same in direction to both ends of the balanced iron core; the balanced iron core entirely vibrates around the center of the magnetic circuit unit under the action of the magnetic forces of the two magnet groups and change of electrical signals, so as to bring the vibrating diaphragm to vibrate for sound generation.

According to the above technical solution, the present invention has the following beneficial technical effects: the present invention provides a balanced vibration system, which, compared with the prior art, is capable of achieving entire vibration of the balanced iron core using the magnetic circuit unit and the vibration unit so as to realize higher signal conversion efficiency and lower power consumption and eliminate distortion generated by single-side vibration.

DETAILED DESCRIPTION OF THE EMBODIMENTS

The present invention will be described in detail below in combination with accompanying drawings.

Embodiment 1

Figure 1:
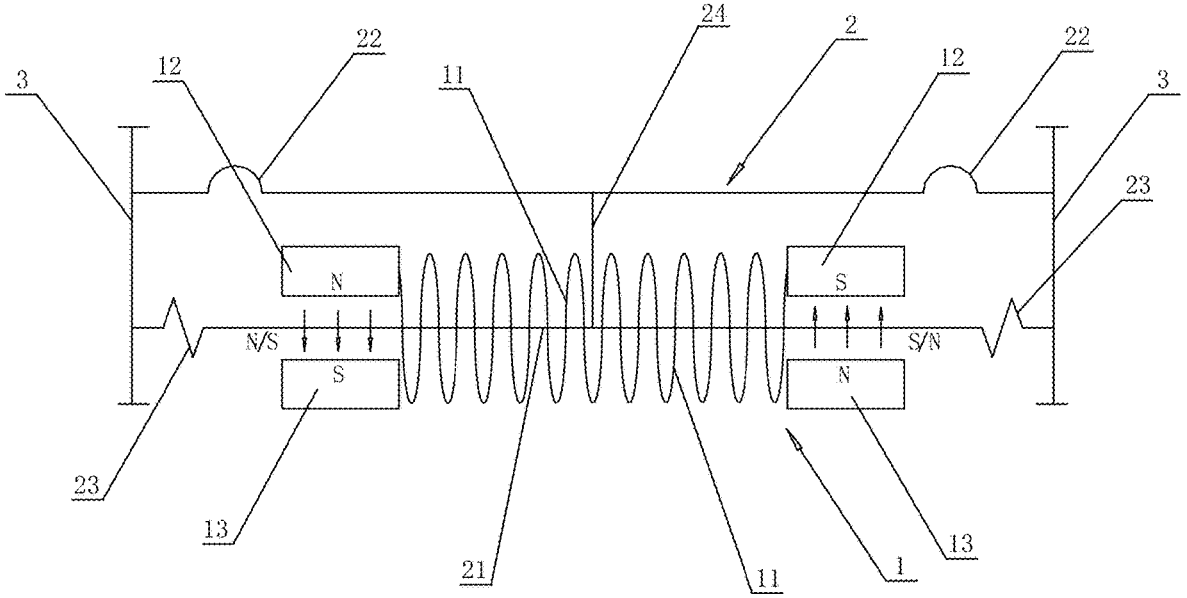
FIG. 1 is a schematic diagram illustrating a structural principle of a balanced vibration system according to a first embodiment of the present invention.

As shown in FIG. 1, provided is a balanced vibration system including a magnetic circuit unit 1, a vibration unit 2 and a casing 3. The magnetic circuit unit 1 and the vibration unit 2 are both located inside the casing 3. The magnetic circuit unit 1 fixed on the casing 3. The vibration unit 2 is elastically connected with the casing 3. The vibration unit 2 vibrates along with change of magnetic field of the magnetic circuit unit 1, so as to achieve vibration. The magnetic circuit unit 1 includes one magnetic circuit coil 11 and two magnet groups. The two magnet groups are located at right and left ends of the magnetic circuit coil 11 along an axial direction respectively. Both ends of the magnetic circuit coil 11 are fixedly connected with the magnet groups at right and left ends respectively. Two terminals of the magnetic circuit coil 11 are fixed on the casing 3 and may be electrically connected to a signal source through a wire. According to electromagnetic conversion law, the magnetic circuit coil 11 may generate an induced magnetic field with varying magnetic field intensity and direction along with change of size and direction of input signal current.

The vibration unit 2 includes a balanced iron core 21 and a vibrating diaphragm 22. The balanced iron core 21 is made of a magnetically-conductive material. The balanced iron core 21 is disposed inside the magnetic circuit coil 11 and the left and right ends of the balanced iron core 21 are protruded into two magnet groups respectively. Each magnet group includes two magnets, i.e. a first magnet 12 and a second magnet 13. The first magnet 12 and the second magnet 13 in a same magnet group are arranged oppositely at both sides of the balanced iron core 21. The magnetic circuit unit 1 further includes a support body which is fixed inside the casing 3. All magnets are fixed on the support body. The ends, close to each other, of the first magnet 12 and the second magnet 13 in a same magnet group have opposite magnetic poles, and lines of magnetic forces between the first magnet 12 and the second magnet 13 are all perpendicular to an axis of the magnetic circuit coil 11.

Specifically, an end, close to the axis of the magnetic circuit coil 11, of the first magnet 12 of the magnet group at the left end of the magnetic circuit coil 11 is N pole, an end, close to the axis of the magnetic circuit coil 11, of the second magnet 13 of the magnet group at the left end of the magnetic circuit coil 11 is S pole, an end, close to the axis of the magnetic circuit coil 11, of the first magnet 12 of the magnet group at the right end of the magnetic circuit coil 11 is S pole, and an end, close to the axis of the magnetic circuit coil 11, of the second magnet 13 of the magnet group at the right end of the magnetic circuit coil 11 is N pole. A magnetic field direction between two magnets of the magnet group at the left end of the magnetic circuit coil 11 is opposite to a magnetic field direction between two magnets of the magnet group at the right end of the magnetic circuit coil 11. Specifically, the magnetic field direction between the first magnet 12 and the second magnet 13 at the left end of the magnetic circuit coil 11 points from the first magnet 12 to the second magnet 13, and the magnetic field direction between the first magnet 12 and the second magnet 13 at the right end of the magnetic circuit coil 11 points from the second magnet 13 to the first magnet 12.

Both ends of the balanced iron core 21 protrude out of outer sides of the two magnet groups respectively to connect with the casing through elastic components. When the magnetic circuit coil is in a non-powered-on state, the elastic components enable the balanced iron core to stay at a central position of the magnetic circuit unit and connect with the casing 3. The elastic component is preferably a spring sheet 23. Two spring sheets 23 are provided. One end of the balanced iron core 21 is connected with the casing 3 through one spring sheet 23. One end of the spring sheet 23 is fixedly connected with the balanced iron core 21 and the other end of the spring sheet 23 is fixedly connected with the casing 3. The elastic component is not limited to the spring sheet 23 and thus may also be a spring or another elastic structure. When the magnetic circuit coil 11 is in a non-powered-on state, two spring sheets 23 enable the balanced iron core 21 to stay at the central position of the magnetic circuit unit 1. The weight of the balanced iron core 21 is negligible. Specifically, the balanced iron core 21 stays on the axis of the magnetic circuit coil 11 and also stays at a middle position of the first magnet 12 and the second magnet 13.

The vibration unit 2 further includes a connection piece 24. One end of the connection piece 24 is fixedly connected with a middle portion of the balanced iron core 21 and the other end of the connection piece 24 is fixedly connected with the vibrating diaphragm 22. Like an ordinary moving iron diaphragm, an edge of the vibrating diaphragm 22 is directly bonded to the casing 3 or fixedly connected with the casing 3 in another feasible manner. The balanced iron core 21 vibrates entirely under the action of varying magnetic field force and conveys the vibration to the vibrating diaphragm 22 via the connection piece 24, such that the vibrating diaphragm 22 generates vibration.

The balanced vibration system works based on the following principle: the balanced iron core 21 is made of a magnetically-conductive material; after electrical signals pass through the magnetic circuit coil 11 of the magnetic circuit unit 1, the balanced iron core 21 is magnetized to enable two ends of the balanced iron core 21 to have opposite magnetic poles (the left end is S, the right end is N pole, or vice versa); two ends of the balanced iron core 21 are located in two magnet groups having opposite magnetic field directions respectively, and receive magnetic forces which are equal in size and same in direction. Under the action of the magnetic forces of the two magnet groups, the balanced iron core 21 entirely vibrates around the center of the magnetic circuit unit 1 so as to bring the vibrating diaphragm 22 to vibrate.

Embodiment 2

Figure 2:
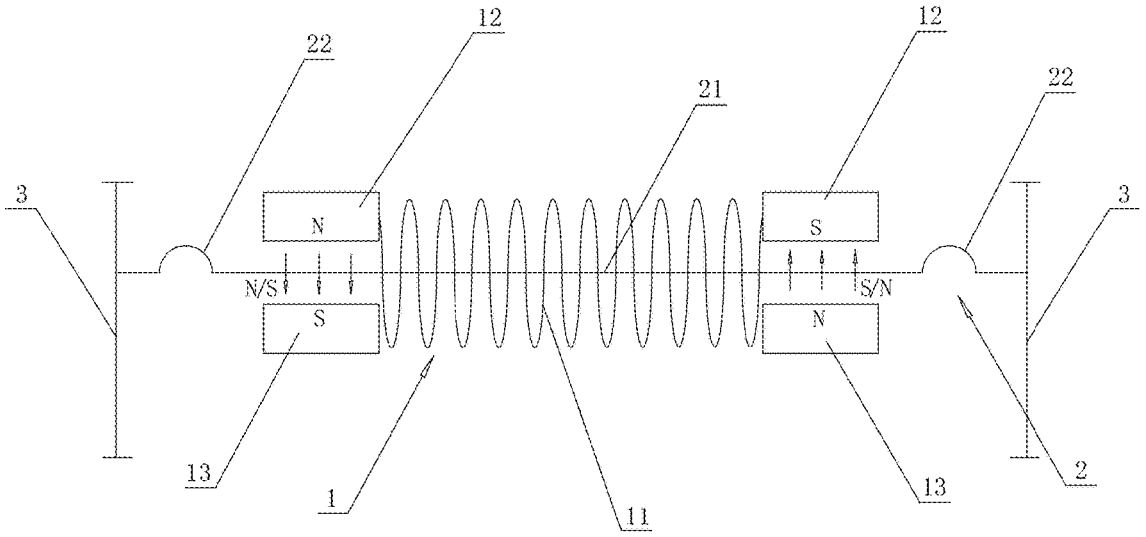
FIG. 2 is a schematic diagram illustrating a structural principle of a balanced vibration system according to a second embodiment of the present invention.

As shown in FIG. 2, provided is a balanced vibration system, including a magnetic circuit unit 1, a vibration unit 2 and a casing 3. The magnetic circuit unit 1 and the vibration unit 2 are both located inside the casing 3. The magnetic circuit unit 1 fixed on the casing 3. The vibration unit 2 is elastically connected with the casing 3. The vibration unit 2 vibrates along with change of magnetic field of the magnetic circuit unit 1, so as to achieve vibration. The magnetic circuit unit 1 includes one magnetic circuit coil 11 and two magnet groups. The two magnet groups are located at right and left ends of the magnetic circuit coil 11 along an axial direction respectively. Both ends of the magnetic circuit coil 11 are fixedly connected with the magnet groups at right and left ends respectively. Two terminals of the magnetic circuit coil 11 are fixed on the casing 3 and may be electrically connected to a signal source through a wire. According to electromagnetic conversion law, the magnetic circuit coil 11 may generate an induced magnetic field with varying magnetic field intensity and direction along with change of size and direction of input signal current.

The vibration unit 2 includes a balanced iron core 21 and a vibrating diaphragm 22. The balanced iron core 21 is made of a magnetically-conductive material. The balanced iron core 21 is disposed inside the magnetic circuit coil 11 and the left and right ends of the balanced iron core 21 are protruded into two magnet groups respectively. Each magnet group includes two magnets, i.e. a first magnet 12 and a second magnet 13. The first magnet 12 and the second magnet 13 in a same magnet group are arranged oppositely at both sides of the balanced iron core 21. The magnetic circuit unit 1 further includes a support body which is fixed inside the casing 3. All magnets are fixed on the support body. The ends, close to each other, of the first magnet 12 and the second magnet 13 in a same magnet group have opposite magnetic poles, and lines of magnetic forces between the first magnet 12 and the second magnet 13 are all perpendicular to an axis of the magnetic circuit coil 11.

Specifically, an end, close to the axis of the magnetic circuit coil 11, of the first magnet 12 of the magnet group at the left end of the magnetic circuit coil 11 is N pole, an end, close to the axis of the magnetic circuit coil 11, of the second magnet 13 of the magnet group at the left end of the magnetic circuit coil 11 is S pole, an end, close to the axis of the magnetic circuit coil 11, of the first magnet 12 of the magnet group at the right end of the magnetic circuit coil 11 is S pole, and an end, close to the axis of the magnetic circuit coil 11, of the second magnet 13 of the magnet group at the right end of the magnetic circuit coil 11 is N pole. A magnetic field direction between two magnets of the magnet group at the left end of the magnetic circuit coil 11 is opposite to a magnetic field direction between two magnets of the magnet group at the right end of the magnetic circuit coil 11. Specifically, the magnetic field direction between the first magnet 12 and the second magnet 13 at the left end of the magnetic circuit coil 11 points from the first magnet 12 to the second magnet 13, and the magnetic field direction between the first magnet 12 and the second magnet 13 at the right end of the magnetic circuit coil 11 points from the second magnet 13 to the first magnet 12.

A middle portion of the vibrating diaphragm 22 is located inside the magnetic circuit coil 11 and between the first magnet 12 and the second magnet 13, and the vibrating diaphragm 22 and the balanced iron core 21 are made into an integral structure which has the same function as the balanced iron core 21 and the vibrating diaphragm 22 in the first embodiment. An edge of the integral structure is fixedly bonded to the casing 3. When the balanced iron core 21 entirely vibrates under the action of a magnetic field force, the vibrating diaphragm 22 vibrates together with the balanced iron core 21. The weight of the balanced iron core 21 is negligible. When the magnetic circuit coil 11 is in a non-powered-on state, the vibrating diaphragm 22 enables the balanced iron core 21 to stay at the axis of the magnetic circuit coil 11 and also at the middle position of the first magnet 12 and the second magnet 13. The structure of the balanced vibration system in the second embodiment has a decreased total thickness, which meets the requirements of miniaturization of the manufactured products.

Embodiment 3

Figure 3:
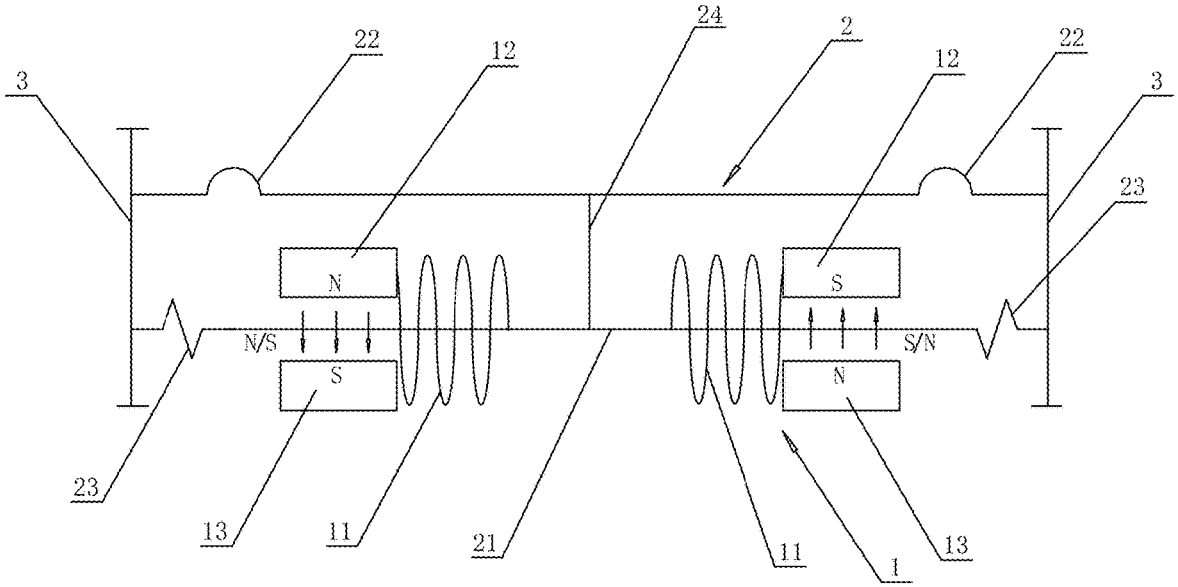
FIG. 3 is a schematic diagram illustrating a structural principle of a balanced vibration system according to a third embodiment of the present invention.
Figure 4:
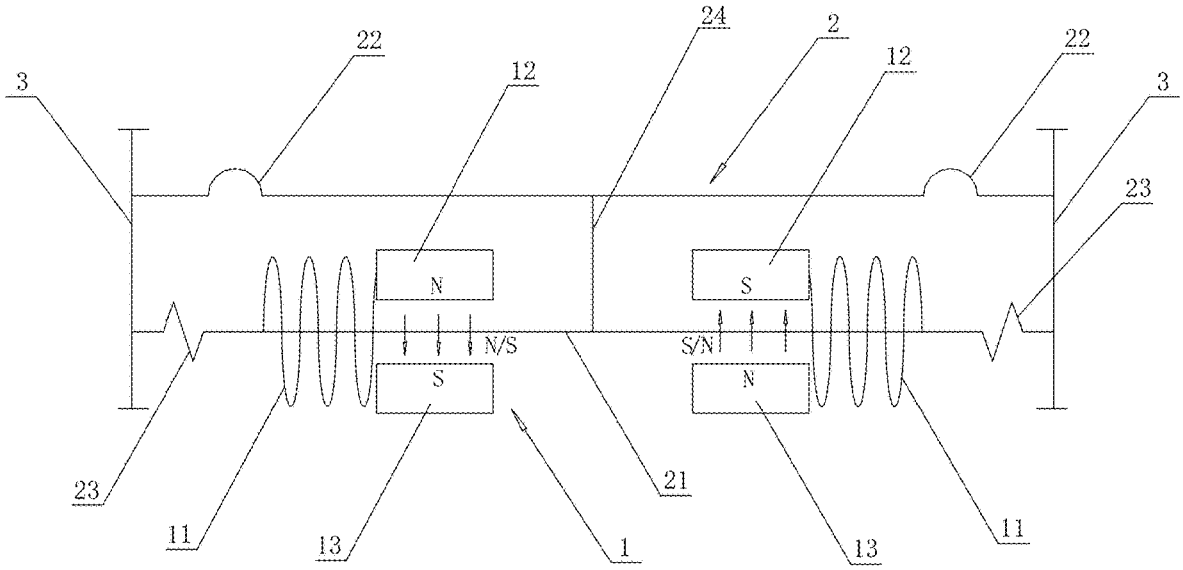
FIG. 4 is a schematic diagram illustrating a structural principle of a balanced vibration system according to a fourth embodiment of the present invention.

As shown in FIGS. 3 and 4, the third embodiment has the same principle as the first embodiment. The third embodiment is basically identical in structure to the first embodiment, except for the followings: the magnetic circuit unit 1 in the third embodiment includes two magnetic circuit coils 11 which are located at the opposed sides of two magnet groups respectively, that is, the two magnetic circuit coils 11 are located between the two magnet groups, and the ends of the two magnetic circuit coils 11 that are away from each other are fixedly connected with the corresponding magnet groups (as shown in FIG. 3). Furthermore, two magnetic circuit coils 11 may also be located at the contrary sides of the two magnet groups respectively, that is, the two magnetic circuit coils 11 are located at outer sides of the two magnet groups, and the ends of the two magnetic circuit coils 11 that are opposed to each other are fixedly connected with the corresponding magnet groups (as shown in FIG. 4). The two magnetic circuit coils 11 are synchronously powered on or off. When the two magnetic circuit coils 11 are in a powered-on state, the balanced iron core 21 generates opposite magnetic poles at positions corresponding to the two magnet groups, and action forces applied by the two magnet groups to the balanced iron core 21 are always consistent in direction, for example, synchronously up or down. In this case, the balanced iron core 21 drives the vibrating diaphragm 22 to vibrate up and down. The arrangement of two magnetic circuit coils 11 in the third embodiment belongs to a structural variation of the first embodiment and can achieve the same effect as the first embodiment.

Embodiment 4

Figure 5:
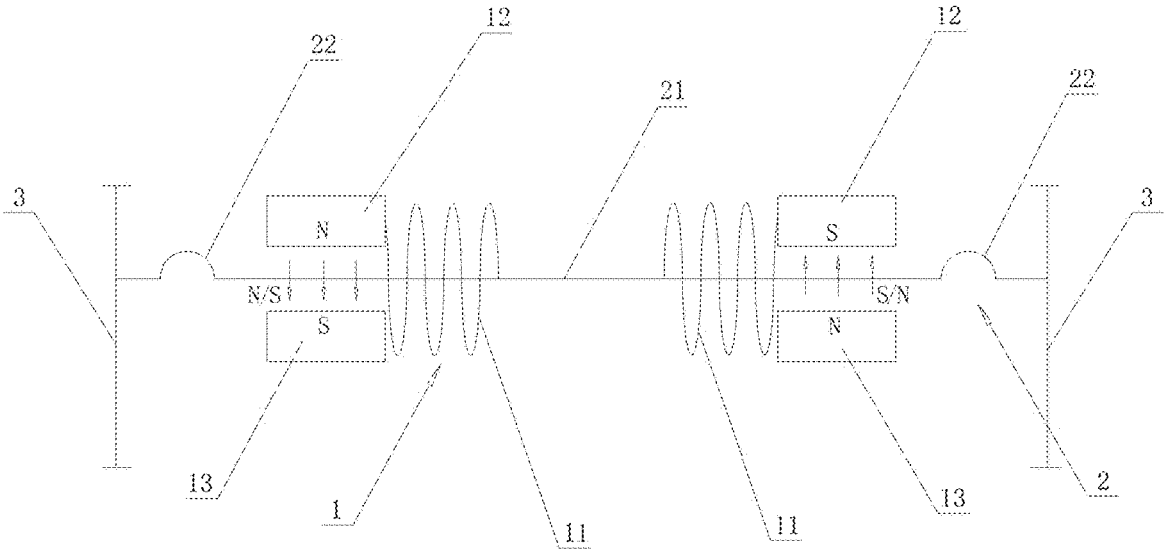
FIG. 5 is a schematic diagram illustrating a structural principle of a balanced vibration system according to a fifth embodiment of the present invention.
Figure 6:
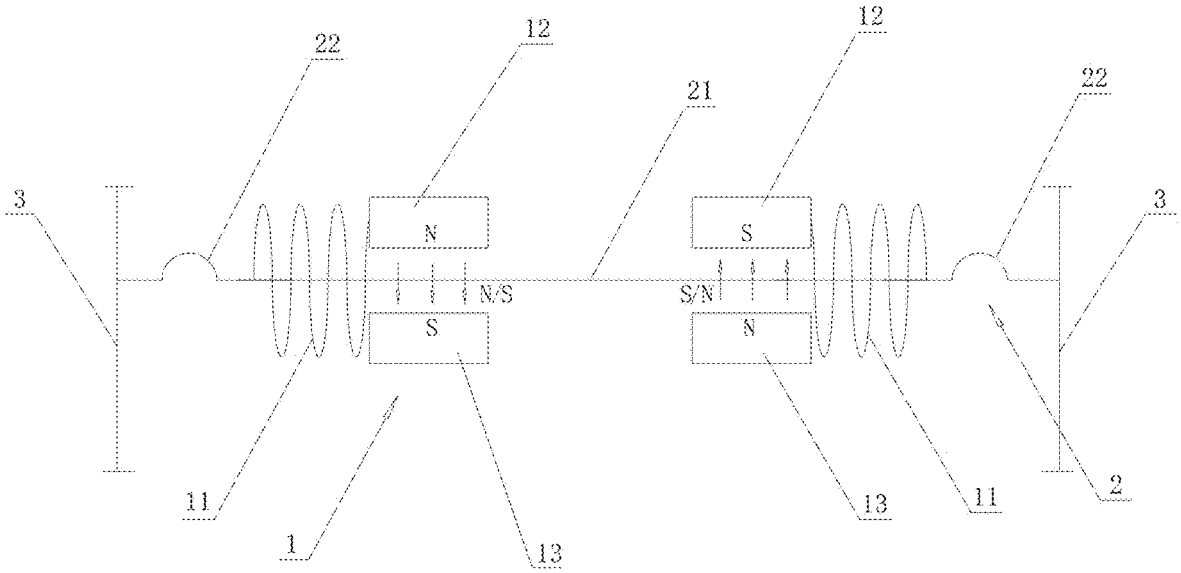
FIG. 6 is a schematic diagram illustrating a structural principle of a balanced vibration system according to a sixth embodiment of the present invention.

As shown in FIGS. 5 and 6, the fourth embodiment has the same principle as the second embodiment. The fourth embodiment is basically identical in structure to the second embodiment, except for the followings: the magnetic circuit unit 1 in the fourth embodiment includes two magnetic circuit coils 11 which are located at the opposed sides of two magnet groups respectively, that is, the two magnetic circuit coils 11 are located between the two magnet groups, and the ends of the two magnetic circuit coils 11 that are away from each other are fixedly connected with the corresponding magnet groups (as shown in FIG. 5). Furthermore, two magnetic circuit coils 11 may also be located at the contrary sides of the two magnet groups respectively, that is, the two magnetic circuit coils 11 are located at outer sides of the two magnet groups, and the ends of the two magnetic circuit coils 11 that are opposed to each other are fixedly connected with the corresponding magnet groups (as shown in FIG. 6). The two magnetic circuit coils 11 are synchronously powered on or off. When the two magnetic circuit coils 11 are in a powered-on state, the balanced iron core 21 generates opposite magnetic poles at positions corresponding to the two magnet groups, and action forces applied by the two magnet groups to the balanced iron core 21 are always consistent in direction, for example, synchronously up or down. In this case, the balanced iron core 21 drives the vibrating diaphragm 22 to vibrate up and down. The arrangement of two magnetic circuit coils 11 in the fourth embodiment belongs to a structural variation of the second embodiment and can achieve the same effect as the second embodiment.

Those parts not mentioned in the present invention may be implemented by using the prior art.

Furthermore, the terms "first" and "second" are used only for the purpose of descriptions and shall not be understood as indicating or implying relative importance.

The specific embodiments described herein are merely illustrative of the spirit of the present invention. Various modifications, or supplementations or other similar substitutions made by those skilled in the art to the specific embodiments described herein shall all fall within the spirit or scope of protection of the appended claims.

The invention claimed is:

1. A balanced vibration system, comprising a magnetic circuit unit, a vibration unit and a casing, wherein the magnetic circuit unit and the vibration unit are located inside the casing, the vibration unit comprises a balanced iron core and a vibrating diaphragm; the balanced iron core is movably connected with the casing, the vibrating diaphragm is fixed on the casing, and the balanced iron core drives the vibrating diaphragm to move; the magnetic circuit unit comprises a magnetic circuit coil and two magnet groups, the magnetic circuit coil is sleeved on the balanced iron core, and the two magnet groups are respectively located at both ends of the balanced iron core along an axial direction; each magnet group comprises two magnets which are arranged oppositely at both sides of the balanced iron core; when the magnetic circuit coil is in a powered-on state, magnetic field forces applied by the two magnet groups to the balanced iron core are same in direction;

the both ends of the balanced iron core protrude out of outer sides of the two magnet groups respectively to connect with the casing through elastic components;

the vibration unit further comprises a connection piece, one end of which is fixedly connected with the balanced iron core and the other end is fixedly connected with the vibrating diaphragm;

there are two magnetic circuit coils which are located at the opposed or contrary sides of the two magnet groups respectively, and a corresponding end of each magnetic circuit coil is fixedly connected with the magnet group adjacent to the magnetic circuit coil; and the two magnetic circuit coils are synchronously powered on or off, when the two magnetic circuit coils are in a powered-on state, the balanced iron core drives the vibrating diaphragm to vibrate up and down.

2. The balanced vibration system of claim 1, wherein the balanced iron core and the vibrating diaphragm are of integral structure, an edge of the vibrating diaphragm is fixedly connected with the casing, and the balanced iron core drives the vibrating diaphragm to vibrate up and down.

3. The balanced vibration system of claim 1, wherein magnetic poles of the opposed ends of the two magnets in a same magnet group are opposite.

4. The balanced vibration system of claim 1, wherein a magnetic field direction between two magnets in one magnet group is opposite to a magnetic field direction between two magnets in the other magnet group.

5. The balanced vibration system of claim 1, wherein the balanced iron core is connected with the casing through an elastic component, and the elastic component enables the balanced iron core to stay at a central position of the magnetic circuit unit in a case that the magnetic circuit coil is in a non-powered-on state.

6. The balanced vibration system of claim 1, further comprising a support body, wherein the support body is fixed inside the casing, and all magnets are mounted on the support body.

7. The balanced vibration system of claim 2, wherein the elastic component is a spring or a spring sheet.

8. A balanced vibration system, comprising a magnetic circuit unit, a vibration unit and a casing, wherein the magnetic circuit unit and the vibration unit are located inside the casing, the vibration unit comprises a balanced iron core and a vibrating diaphragm; the balanced iron core is movably connected with the casing, the vibrating diaphragm is fixed on the casing, and the balanced iron core drives the vibrating diaphragm to move; the magnetic circuit unit comprises a magnetic circuit coil and two magnet groups, the magnetic circuit coil is sleeved on the balanced iron core, and the two magnet groups are respectively located at both ends of the balanced iron core along an axial direction; each magnet group comprises two magnets which are arranged oppositely at both sides of the balanced iron core; when the magnetic circuit coil is in a powered-on state, magnetic field forces applied by the two magnet groups to the balanced iron core are same in direction, wherein there is one magnetic circuit coil located between two magnet groups and both ends of the magnetic circuit coil are fixedly connected with the two magnet groups respectively.

9. The balanced vibration system of claim 8, wherein the vibration unit further comprises a connection piece, one end of which is fixedly connected with the balanced iron core and the other end is fixedly connected with the vibrating diaphragm.

10. The balanced vibration system of claim 8, wherein the balanced iron core and the vibrating diaphragm are of integral structure, an edge of the vibrating diaphragm is fixedly connected with the casing, and the balanced iron core drives the vibrating diaphragm to vibrate up and down.

11. The balanced vibration system of claim 8, wherein magnetic poles of the opposed ends of the two magnets in a same magnet group are opposite.

12. The balanced vibration system of claim 8, wherein a magnetic field direction between two magnets in one magnet group is opposite to a magnetic field direction between two magnets in the other magnet group.

13. The balanced vibration system of claim 9, wherein the balanced iron core is connected with the casing through an elastic component, and the elastic component enables the balanced iron core to stay at a central position of the magnetic circuit unit in a case that the magnetic circuit coil is in a non-powered-on state.

14. The balanced vibration system of claim 8, further comprising a support body, wherein the support body is fixed inside the casing, and all magnets are mounted on the support body.

15. The balanced vibration system of claim 13, wherein the elastic component is a spring or a spring sheet.

* * * * *